US009243218B2

(12) United States Patent
Phenis et al.

(10) Patent No.: US 9,243,218 B2
(45) Date of Patent: Jan. 26, 2016

(54) DYNAMIC MULTIPURPOSE COMPOSITION FOR THE REMOVAL OF PHOTORESISTS AND METHOD FOR ITS USE

(75) Inventors: Michael T. Phenis, Markleville, IN (US); Lauri Kirby Kirkpatrick, Pittsboro, IN (US); Raymond Chan, Carmel, IN (US); Diane Marie Scheele, Greenwood, IN (US); Kimberly Dona Pollard, Anderson, IN (US)

(73) Assignee: Dynaloy, LLC, Kingsport, TN (US)

( * ) Notice: Subject to any disclaimer, the term of this patent is extended or adjusted under 35 U.S.C. 154(b) by 204 days.

(21) Appl. No.: 12/637,828

(22) Filed: Dec. 15, 2009

(65) Prior Publication Data

US 2010/0089426 A1 Apr. 15, 2010

Related U.S. Application Data

(62) Division of application No. 11/260,912, filed on Oct. 28, 2005, now Pat. No. 7,632,796.

(51) Int. Cl.

| | |
|---|---|
| ***C11D 7/50*** | (2006.01) |
| ***C11D 11/00*** | (2006.01) |
| ***C11D 1/00*** | (2006.01) |
| ***C11D 3/30*** | (2006.01) |
| ***C11D 3/43*** | (2006.01) |
| ***C11D 7/32*** | (2006.01) |

(52) U.S. Cl.

CPC ..... *C11D 11/0047* (2013.01); *C11D 1/004* (2013.01); *C11D 3/30* (2013.01); *C11D 3/43* (2013.01); *C11D 7/3209* (2013.01); *C11D 7/3218* (2013.01); *C11D 7/5009* (2013.01)

(58) Field of Classification Search

CPC ..... C11D 11/0047
USPC ..... 510/175, 176; 134/1.3
See application file for complete search history.

(56) References Cited

U.S. PATENT DOCUMENTS

| | | | | |
|---|---|---|---|---|
| 3,562,038 | A | | 2/1971 | Shipley et al. |
| 3,673,099 | A | | 6/1972 | Corby et al. |
| 3,873,668 | A | | 3/1975 | Melby |
| 3,888,891 | A | | 6/1975 | Smith et al. |
| 3,920,695 | A | | 11/1975 | Smith et al. |
| 3,963,744 | A | | 6/1976 | Smith et al. |
| 3,981,859 | A | | 9/1976 | Smith et al. |
| 4,038,293 | A | | 7/1977 | Smith et al. |
| 4,518,675 | A | | 5/1985 | Kataoka |
| 4,547,271 | A | | 10/1985 | Bharucha et al. |
| 4,787,997 | A | | 11/1988 | Saito et al. |
| 4,803,641 | A | | 2/1989 | Hardy et al. |
| 4,830,641 | A | | 5/1989 | White, Jr. et al. |
| 4,904,571 | A | | 2/1990 | Miyashita et al. |
| 5,008,273 | A | | 4/1991 | Schnorrenberg et al. |
| 5,233,010 | A | | 8/1993 | McGhee et al. |
| 5,252,737 | A | | 10/1993 | Stern et al. |
| 5,304,284 | A | | 4/1994 | Jagannathan et al. |
| 5,308,745 | A | | 5/1994 | Schwartzkopf |
| 5,369,189 | A | | 11/1994 | Kim et al. |
| 5,417,877 | A | | 5/1995 | Ward |
| 5,419,779 | A | | 5/1995 | Ward |
| 5,422,309 | A | | 6/1995 | Zettler et al. |
| 5,453,541 | A | | 9/1995 | Stern et al. |
| 5,468,423 | A | | 11/1995 | Garabedian, Jr. et al. |
| 5,567,574 | A | | 10/1996 | Hasemi et al. |
| 5,597,678 | A | * | 1/1997 | Honda et al. ..... 430/331 |
| 5,608,111 | A | | 3/1997 | Stern et al. |
| 5,612,304 | A | * | 3/1997 | Honda et al. ..... 510/176 |
| 5,623,088 | A | | 4/1997 | Stern et al. |
| 5,648,324 | A | | 7/1997 | Honda et al. |
| 5,795,702 | A | | 8/1998 | Tanabe et al. |
| 5,798,323 | A | | 8/1998 | Honda et al. |
| 5,840,622 | A | | 11/1998 | Miles et al. |
| 5,928,430 | A | | 7/1999 | Ward et al. |
| 6,033,996 | A | | 3/2000 | Rath et al. |
| 6,063,522 | A | | 5/2000 | Hamrock et al. |
| 6,137,010 | A | | 10/2000 | Joo et al. |
| 6,200,891 | B1 | | 3/2001 | Jagannathan et al. |
| 6,225,030 | B1 | | 5/2001 | Tanabe et al. |
| 6,276,372 | B1 | | 8/2001 | Lee |
| 6,310,020 | B1 | | 10/2001 | Shirota et al. |
| 6,319,835 | B1 | | 11/2001 | Sahbari et al. |
| 6,372,410 | B1 | | 4/2002 | Ikemoto et al. |
| 6,399,273 | B1 | | 6/2002 | Yamada et al. |

(Continued)

FOREIGN PATENT DOCUMENTS

| | | | |
|---|---|---|---|
| CN | 101907835 | A | 12/2010 |
| EP | 0 678 571 | A | 10/1995 |

(Continued)

OTHER PUBLICATIONS

Patent Application Search Report mailed on Jun. 5, 2008.

Ho et al., Wafer-Scale, Sub-5 nm Junction Formation by Monolayer Doping and Conventional Spike Annealing, Nano Letters, 2009, vol. 9, No. 2, pp. 725-730, entire document, especially: pp. 726, col. 1, para. 2.

Ho et al., Controlled Nanoscale Doping of Semiconductors via Molecular Monolayers, Nature Materials, vol. 7, Jan. 2008, pp. 62-67, entire document.

(Continued)

*Primary Examiner* — Gregory Webb
(74) *Attorney, Agent, or Firm* — Lee & Hayes, PLLC

(57) ABSTRACT

Methods for using improved stripper solutions having dimethyl sulfoxide; a quaternary ammonium hydroxide; an alkanolamine having at least two carbon atoms, at least one amino substituent and at least one hydroxyl substituent, with the amino and hydroxyl substituents being attached to two different carbon atoms; and a surfactant. Some formulation can additionally contain a secondary solvent. The stripper solutions are effective for removing photoresists from substrates, and typically have freezing points below about +15° C. and high loading capacities.

20 Claims, No Drawings

(56) References Cited

U.S. PATENT DOCUMENTS

| | | | | |
|---|---|---|---|---|
| 6,455,479 | B1 | 9/2002 | Sahbari | |
| 6,465,403 | B1 * | 10/2002 | Skee | 510/175 |
| 6,482,656 | B1 | 11/2002 | Lopatin | |
| 6,531,436 | B1 | 3/2003 | Sahbari et al. | |
| 6,566,322 | B1 | 5/2003 | Brook et al. | |
| 6,579,668 | B1 | 6/2003 | Baik et al. | |
| 6,579,688 | B2 | 6/2003 | Steaffens et al. | |
| 6,585,825 | B1 | 7/2003 | Skee | |
| 6,638,694 | B2 | 10/2003 | Ikemoto et al. | |
| 6,683,219 | B2 | 1/2004 | DeLuca et al. | |
| 6,777,380 | B2 | 8/2004 | Small et al. | |
| 6,825,156 | B2 | 11/2004 | Lee et al. | |
| 6,844,461 | B2 | 1/2005 | DeLuca et al. | |
| 6,846,748 | B2 | 1/2005 | Chien et al. | |
| 6,872,633 | B2 | 3/2005 | Huang et al. | |
| 6,872,663 | B1 | 3/2005 | Okada | |
| 6,878,500 | B2 | 4/2005 | Rutter, Jr. et al. | |
| 6,916,772 | B2 * | 7/2005 | Zhou et al. | 510/201 |
| 7,049,275 | B2 * | 5/2006 | Ikemoto et al. | 510/176 |
| 7,064,087 | B1 | 6/2006 | Turner et al. | |
| 7,078,371 | B2 | 7/2006 | Ikemoto | |
| 7,144,848 | B2 | 12/2006 | Zhou et al. | |
| 7,157,605 | B2 | 1/2007 | Kim et al. | |
| 7,166,362 | B2 | 1/2007 | Kano | |
| 7,528,098 | B2 | 5/2009 | Lee et al. | |
| 7,543,592 | B2 | 6/2009 | Lee | |
| 7,579,308 | B2 | 8/2009 | Lee | |
| 7,615,377 | B2 | 11/2009 | Lippard et al. | |
| 7,632,796 | B2 * | 12/2009 | Phenis et al. | 510/175 |
| 7,960,328 | B2 | 6/2011 | Visintin et al. | |
| 8,030,263 | B2 * | 10/2011 | Egbe et al. | 510/175 |
| 8,263,539 | B2 * | 9/2012 | Phenis et al. | 510/176 |
| 8,440,389 | B2 * | 5/2013 | Pollard et al. | 430/329 |
| 8,697,345 | B2 | 4/2014 | Wakiya et al. | |
| 8,987,181 | B2 | 3/2015 | Pollard et al. | |
| 2001/0014534 | A1 | 8/2001 | Aoki et al. | |
| 2002/0037819 | A1 | 3/2002 | Sahbari | |
| 2002/0037820 | A1 | 3/2002 | Small et al. | |
| 2002/0128164 | A1 | 9/2002 | Hara et al. | |
| 2002/0152925 | A1 | 10/2002 | Soutar et al. | |
| 2003/0114014 | A1 * | 6/2003 | Yokoi et al. | 438/745 |
| 2003/0130149 | A1 | 7/2003 | Zhou et al. | |
| 2003/0138737 | A1 * | 7/2003 | Wakiya et al. | 430/331 |
| 2003/0181344 | A1 * | 9/2003 | Ikemoto et al. | 510/175 |
| 2003/0186175 | A1 | 10/2003 | Ikemoto et al. | |
| 2003/0194636 | A1 | 10/2003 | Wanat et al. | |
| 2003/0228990 | A1 | 12/2003 | Lee et al. | |
| 2004/0038840 | A1 * | 2/2004 | Lee et al. | 510/202 |
| 2004/0048761 | A1 | 3/2004 | Ikemoto | |
| 2004/0081922 | A1 | 4/2004 | Ikemoto et al. | |
| 2004/0106532 | A1 | 6/2004 | Yokoi et al. | |
| 2004/0134873 | A1 | 7/2004 | Yao et al. | |
| 2004/0147420 | A1 | 7/2004 | Zhou et al. | |
| 2004/0147421 | A1 | 7/2004 | Charm et al. | |
| 2004/0220066 | A1 * | 11/2004 | Rutter, Jr. | 510/175 |
| 2004/0256358 | A1 * | 12/2004 | Shimizu et al. | 216/83 |
| 2004/0266912 | A1 | 12/2004 | Aida et al. | |
| 2005/0014667 | A1 | 1/2005 | Aoyama et al. | |
| 2005/0016961 | A1 | 1/2005 | Toda et al. | |
| 2005/0074556 | A1 | 4/2005 | Kano | |
| 2005/0084792 | A1 * | 4/2005 | Yokoi et al. | 430/256 |
| 2005/0090416 | A1 | 4/2005 | Lee et al. | |
| 2005/0112769 | A1 | 5/2005 | Lippard et al. | |
| 2005/0143365 | A1 | 6/2005 | Kim et al. | |
| 2005/0176259 | A1 | 8/2005 | Yokoi et al. | |
| 2005/0202987 | A1 | 9/2005 | Small et al. | |
| 2005/0261508 | A1 | 11/2005 | Zasloff et al. | |
| 2005/0263743 | A1 | 12/2005 | Lee | |
| 2006/0003910 | A1 * | 1/2006 | Hsu et al. | 510/176 |
| 2006/0014656 | A1 | 1/2006 | Egbe et al. | |
| 2006/0046446 | A1 | 3/2006 | Kon et al. | |
| 2006/0073997 | A1 | 4/2006 | Leonte et al. | |
| 2006/0094613 | A1 | 5/2006 | Lee | |
| 2006/0099831 | A1 | 5/2006 | Borovik et al. | |
| 2006/0138399 | A1 | 6/2006 | Itano et al. | |
| 2006/0199749 | A1 | 9/2006 | Suzuki et al. | |
| 2006/0293208 | A1 * | 12/2006 | Egbe et al. | 510/407 |
| 2007/0037087 | A1 * | 2/2007 | Yokoi et al. | 430/256 |
| 2007/0066502 | A1 | 3/2007 | Brainard et al. | |
| 2007/0099805 | A1 | 5/2007 | Phenis et al. | |
| 2007/0111912 | A1 | 5/2007 | Phenis et al. | |
| 2007/0149430 | A1 | 6/2007 | Egbe et al. | |
| 2007/0243773 | A1 | 10/2007 | Phenis et al. | |
| 2008/0011714 | A1 | 1/2008 | Yokoi et al. | |
| 2008/0070404 | A1 | 3/2008 | Beck et al. | |
| 2008/0076688 | A1 | 3/2008 | Barnes et al. | |
| 2008/0139436 | A1 | 6/2008 | Reid | |
| 2008/0261847 | A1 | 10/2008 | Visintin et al. | |
| 2009/0047609 | A1 | 2/2009 | Atkinson et al. | |
| 2009/0119979 | A1 | 5/2009 | Mullen | |
| 2009/0186793 | A1 | 7/2009 | Phenis et al. | |
| 2010/0056409 | A1 | 3/2010 | Walker et al. | |
| 2010/0089426 | A1 * | 4/2010 | Phenis et al. | 134/34 |
| 2010/0104824 | A1 | 4/2010 | Phenis et al. | |
| 2010/0112728 | A1 | 5/2010 | Korzenski et al. | |
| 2010/0152086 | A1 | 6/2010 | Wu et al. | |
| 2010/0221503 | A1 | 9/2010 | Pollard et al. | |
| 2010/0242998 | A1 | 9/2010 | Quillen et al. | |
| 2010/0249181 | A1 | 9/2010 | DeGoey et al. | |
| 2010/0298605 | A1 | 11/2010 | Hirose et al. | |
| 2011/0212866 | A1 | 9/2011 | Rao et al. | |
| 2011/0311921 | A1 | 12/2011 | Egbe et al. | |
| 2013/0143785 | A1 | 6/2013 | Taniguchi et al. | |
| 2013/0161840 | A1 | 6/2013 | Pollard et al. | |
| 2013/0172225 | A1 | 7/2013 | Phenis et al. | |

FOREIGN PATENT DOCUMENTS

| | | | |
|---|---|---|---|
| EP | 1 128 221 | A2 | 8/2001 |
| EP | 1 211 563 | A1 | 6/2002 |
| EP | 1 562 225 | A | 8/2005 |
| EP | 1619557 | A1 | 1/2006 |
| EP | 1 736 534 | A1 | 12/2006 |
| JP | 62-188785 | A | 8/1987 |
| JP | 07-28254 | A | 1/1995 |
| JP | H11316465 | A | 11/1999 |
| JP | 2001-244258 | A | 9/2001 |
| JP | 2001-312074 | A | 11/2001 |
| JP | 2003-005383 | A | 1/2003 |
| JP | 2003-255565 | A | 9/2003 |
| JP | 2004-093678 | A | 3/2004 |
| JP | 2004-133153 | A | 4/2004 |
| SU | 1 807 077 | A1 | 4/1993 |
| TW | 526397 | B | 4/2003 |
| WO | 99/19447 | A1 | 4/1999 |
| WO | 02/04233 | A1 | 1/2002 |
| WO | 03/006597 | A1 | 1/2003 |
| WO | 03/006598 | A1 | 1/2003 |
| WO | 03/007085 | A1 | 1/2003 |
| WO | 03 083920 | A | 10/2003 |
| WO | 2007/053363 | A2 | 5/2007 |
| WO | 2009051237 | A1 | 4/2009 |
| WO | 2011/012559 | A2 | 2/2011 |
| WO | 2011/025180 | A2 | 3/2011 |
| WO | 2014/081464 | A1 | 5/2014 |

OTHER PUBLICATIONS

"Resorcinol CAS# 108-46-3", IS Chemical Technology, 2010.

Database WPI Week 199424, Derwent Publications Ltd., London.

Notification of Transmittal of the International Search Report dated Feb. 21, 2008 for corresponding PCT/US2007/066128.

Notification of Transmittal of the International Search Report dated Jan. 12, 2009 for corresponding PCT/US2008/071485.

Notification of Transmittal of the International Search Report dated Feb. 27, 2009 for corresponding PCT/US2008/072923.

Written opinion of the International Searching Authority dated Feb. 21, 2008 for corresponding PCT/US2007/066128.

Written opinion of the International Searching Authority dated Feb. 27, 2009 for corresponding PCT/US2008/072923.

Written opinion of the International Searching Authority dated Nov. 25, 2009 for corresponding PCT/US2009/048409.

Notification of Transmittal of the International Search Report dated Nov. 25, 2009 for corresponding PCT/US2009/048409.

(56) References Cited

OTHER PUBLICATIONS

Notification of Transmittal of the International Search Report dated May 13, 2011 for corresponding PCT/US2011/027493.
Written opinion of the International Searching Authority dated May 13, 2011 for corresponding PCT/US2011/027493.
Related U.S. Appl. No. 60/953,804, filed Aug. 3, 2007.
Related U.S. Appl. No. 60/956,030, filed Aug. 15, 2007.
Related U.S. Appl. No. 61/075,195, filed Jun. 24, 2008.
Related U.S. Appl. No. 61/311,516, filed Mar. 8, 2010.
Non-Final Office Action mailed Dec. 15, 2008 for related U.S. Appl. No. 11/260,912.
Notice of Allowance mailed Aug. 28, 2009 for related U.S. Appl. No. 11/260,912.
Non-Final Office Action mailed Jun. 17, 2010 for related U.S. Appl. No. 11/551,826.
Non-Final Office Action mailed Aug. 25, 2011 for U.S. Appl. No. 11/551,826.
Non-Final Office Action mailed Jul. 19, 2011 for U.S. Appl. No. 12/637,828.
Non-Final Office Action mailed Apr. 3, 2009 for U.S. Appl. No. 11/928,754.
Non-Final Office Action mailed Mar. 22, 2010 for U.S. Appl. No. 12/697,470.
Non-Final Office Action mailed Sep. 29, 2008 for related U.S. Appl. No. 11/828,728.
Non-Final Office Action mailed May 15, 2009 for related U.S. Appl. No. 11/828,728.
Non-Final Office Action mailed Jan. 20, 2011 for related U.S. Appl. No. 11/828,728.
Non-Final Office Action mailed Sep. 14, 2011 for related U.S. Appl. No. 11/828,728.
Final Office Action mailed Mar. 10, 2010 for related U.S. Appl. No. 11/828,728.
Non-Final Office Action mailed Aug. 17, 2011 for related U.S. Appl. No. 12/490,654.
Notice of Allowance mailed Nov. 17, 2011 for related U.S. Appl. No. 12/637,828.
Notice of Allowance mailed Sep. 30, 2009 for related U.S. Appl. No. 11/928,754.
Notice of Allowance mailed Aug. 23, 2010 for related U.S. Appl. No. 12/697,470.
Notice of Allowance mailed Jan. 25, 2012 for related U.S. Appl. No. 11/551,826.
Related U.S. Appl. No. 11/260,912, filed Oct. 28, 2005.
Related U.S. Appl. No. 11/551,826, filed Oct. 23, 2006.
Related U.S. Appl. No. 12/091,808, filed Oct. 24, 2006.
Related U.S. Appl. No. 12/637,828, filed Dec. 15, 2009.
Related U.S. Appl. No. 11/928,754, filed Oct. 30, 2007.
Related U.S. Appl. No. 12/697,470, filed Feb. 1, 2010.
Related U.S. Appl. No. 11/928,728, filed Oct. 30, 2007.
Related U.S. Appl. No. 12/490,654, filed Jun. 24, 2009.
Related U.S. Appl. No. 13/042,541, filed Mar. 8, 2011.
USPTO Office Action for co-pending U.S. Appl. No. 12/091,808 dated Oct. 15, 2012.
Co-pending U.S. Appl. No. 13/759,237, filed Feb. 5, 2013; Michael Phenis.
Co-pending U.S. Appl. No. 13/769,853, filed Feb. 19, 2013; Kimberly Dona Pollard.
Co-pending U.S. Appl. No. 13/834,513, filed Mar. 15, 2013; Richard Dalton Peters.
USPTO Office Action for co-pending U.S. Appl. No. 13/769,583 dated Jul. 22, 2013.
European Search Report for Application EP 13 00 3730 dated Sep. 9, 2013.
European Search Report for Application EP 13 00 3729 dated Aug. 21, 2013.
USPTO Office Action for co-pending U.S. Appl. No. 13/759,237 dated Nov. 6, 2013.
USPTO Non-Final Office Action dated Oct. 6, 2014 received in U.S. Appl. No. 13/834,513.
USPTO Non-Final Office Action dated Oct. 9, 2014 received in U.S. Appl. No. 13/769,853.
USPTO Non-Final Office Action dated Feb. 6, 2014 received in U.S. Appl. No. 13/759,237.
USPTO Final Office Action dated May 13, 2014 received in U.S. Appl. No. 13/759,237.
Co-pending U.S. Appl. No. 14/174,261, filed on Feb. 6, 2014; Michael T. Phenis.
USPTO Final Office Action dated Feb. 7, 2014 received in U.S. Appl. No. 13/769,583.
Co-pending U.S. Appl. No. 14/174,246, filed on Feb. 6, 2014; Richard Dalton Peters.
USPTO Notice of Allowance dated May 21, 2015 received in U.S. Appl. No. 13/834,513.
USPTO Office Action dated Jan. 16, 2015 received in U.S. Appl. No. 13/834,513.
USPTO Office Action dated Feb. 26, 2015 received in U.S. Appl. No. 13/769,853.
USPTO Office Action dated Mar. 10, 2015 received in U.S. Appl. No. 14/174,246.
USPTO Notice of Allowance dated Mar. 17, 2015 received in U.S. Appl. No. 13/759,237.
USPTO Notice of Allowance dated Apr. 30, 2015 received in U.S. Appl. No. 13/759,237.
Notification of Transmittal of the International Search Report dated Jun. 24, 2015 received in International Patent Application No. PCT/US2015/011692.
USPTO Office Action dated Jun. 22, 2015 received in U.S. Appl. No. 14/174,261.

* cited by examiner

DYNAMIC MULTIPURPOSE COMPOSITION FOR THE REMOVAL OF PHOTORESISTS AND METHOD FOR ITS USE

REFERENCE TO RELATED APPLICATIONS

This application is a divisional application of U.S. patent application Ser. No. 11/260,912, filed on Oct. 28, 2005, issued as U.S. Pat. No. 7,632,796, the entire contents of which are hereby incorporated herein by reference.

FIELD OF THE INVENTION

The present invention relates generally to compositions having the ability to effectively remove photoresists from substrates, and to methods for using such compositions. The compositions disclosed are stripper solutions for the removal of photoresists that have the ability to remain liquid at temperatures below normal room temperature and temperatures frequently encountered in transit and warehousing and additionally have advantageous loading capacities for the photoresist materials that are removed.

SUMMARY

In one aspect of the present invention there are provided photoresist stripper solutions for effectively removing or stripping a photoresist from a substrate. The inventive stripper solutions have particularly high loading capacities for the resist material, and the ability to remain a liquid when subjected to temperatures below normal room temperature that are typically encountered in transit, warehousing and in use in some manufacturing facilities. The compositions according to this present disclosure typically remain liquid to temperatures as low as about −20° C. to about +15° C.

The compositions according to the present disclosure typically contain dimethyl sulfoxide (DMSO), a quaternary ammonium hydroxide, and an alkanolamine. One preferred embodiment contains from about 20% to about 90% dimethyl sulfoxide, from about 1% to about 7% of a quaternary ammonium hydroxide, and from about 1% to about 75% of an alkanolamine having at least two carbon atoms, at least one amino substituent and at least one hydroxyl substituent, the amino and hydroxyl substituents attached to two different carbon atoms. The preferred quaternary groups are ($C_1$-$C_8$) alkyl, arylalkyl and combinations thereof. A particularly preferred quaternary ammonium hydroxide is tetramethyammonium hydroxide. Particularly preferred 1,2-alkanolamines include compounds of the formula:

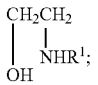

I where $R^1$ can be H, $C_1$-$C_4$ alkyl, or $C_1$-$C_4$ alkylamino. For particularly preferred alkanol amines of formula I, $R^1$ is H or $CH_2CH_2NH_2$. A further embodiment according to this present disclosure contains an additional or secondary solvent. Preferred secondary solvents include glycols, glycol ethers and the like.

A second aspect of the present disclosure provides for methods of using the novel stripper solutions described above to remove photoresist and related polymeric materials from a substrate. A photoresist can be removed from a selected substrate having a photoresist thereon by contacting the substrate with a stripping solution for a time sufficient to remove the desired amount of photoresist, by removing the substrate from the stripping solution, rinsing the stripping solution from the substrate with a solvent and drying the substrate.

A third aspect of the present disclosure includes electronic devices manufactured by the novel method disclosed.

DESCRIPTION OF THE PREFERRED EMBODIMENTS

For the purposes of promoting an understanding of what is claimed, references will now be made to the embodiments illustrated and specific language will be used to describe the same. It will nevertheless be understood that no limitation of the scope of what is claimed is thereby intended, such alterations and further modifications and such further applications of the principles thereof as illustrated therein being contemplated as would normally occur to one skilled in the art to which the disclosure relates.

The compositions according to this present disclosure include dimethyl sulfoxide (DMSO), a quaternary ammonium hydroxide, and an alkanolamine having at least two carbon atoms, at least one amino substituent and at least one hydroxyl substituent, the amino and hydroxyl substituents attached to two different carbon atoms. Preferred quaternary substituents include ($C_1$-$C_8$) alkyl, benzyl and combinations thereof. Preferred compositions have a freezing point of less than about −20° C. up to about +15° C. and a loading capacity of from about 15 $cm^3$/liter up to about 90 $cm^3$/liter. Formulations having increased levels of an alkanolamine (Example 5, for example have the advantages are particularly noncorrosive to carbon steel are less injurious to typical waste treatments systems and auxiliary equipment than other stripper solutions. Particularly preferred compositions contain 1,2-alkanolamines having the formula:

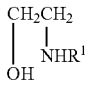

I where $R^1$ is hydrogen, ($C_1$-$C_4$) alkyl, or ($C_1$-$C_4$) alkylamino. Some preferred formulations additionally contain a secondary solvent. Particularly preferred formulations contain from about 2% to about 75% of a secondary solvent. Particularly useful secondary solvents include glycols and their alkyl or aryl ethers described in more detail below. The preferred formulations have freezing points sufficiently below 25° C. to minimize solidification during transportation and warehousing. More preferred formulations have freezing points below about 15° C. Because the preferred stripper solutions remain liquid at low temperatures, the need to liquefy solidified drums of stripper solution received during cold weather or stored in unheated warehouses before the solution can be used is eliminated or minimized. The use of drum heaters to melt solidified stripper solution is time consuming, requires extra handling and can result in incomplete melting and modification of the melted solution's composition.

Additionally, compositions according to the present disclosure display high loading capacities enabling the composition to remove higher levels of photoresists without the precipitation of solids. The loading capacity is defined as the number of $cm^3$ of photoresist or bilayer material that can be removed for each liter of stripper solution before material is re-deposited on the wafer or before residue remains on the wafer. For example, if 20 liters of a stripper solution can remove 300 $cm^3$ of photoresist before either redepositon occurs or residue remains on the wafer, the loading capacity is 300 $cm^3$/20 liters=15 $cm^3$/liter The compositions typically contain about 55% to about 95% solvent, all or most of which is DMSO and from about 2% to about 10% of the quaternary ammonium hydroxide. Preferred quaternary substituents include ($C_1$-$C_8$)alkyl, benzyl and combinations thereof. When used, a secondary solvent typically comprises from about 2% to about 35% of the composition. The stripping formulations can also contain an optional surfactant, typically at levels in the range of about 0.01% to about 3%. Suitable levels of the required alkanolamine can range from about 2% to about 75% of the composition. Because some of the stripper solution's components can be provided as aqueous solutions, the composition can optionally contain small amounts of water. All %'s provided herein are weight percents.

Suitable alkanolamines have at least two carbon atoms and have the amino and hydroxyl substituents on different carbon atoms. Suitable alkanolamines include, but are not limited to, ethanolamine, N-methylethanolamine, N-ethylethanolamine, N-propylethanolamine, N-butylethanolamine, diethanolamine, triethanolamine, N-methyldiethanolamine, N-ethyldiethanolamine, isopropanolamine, diisopropanolamine, triisopropanolamine, N-methylisopropanolamine, N-ethylisopropanolamine, N-propylisopropanolamine, 2-aminopropane-1-ol, N-methyl-2-aminopropane-1-ol, N-ethyl-2-aminopropane-1-ol, 1-aminopropane-3-ol, N-methyl-1-aminopropane-3-ol, N-ethyl-1-aminopropane-3-ol, 1-aminobutane-2-ol, N-methyl-1-aminobutane-2-ol, N-ethyl-1-aminobutane-2-ol, 2-aminobutane-1-ol, N-methyl-2-aminobutane-1-ol, N-ethyl-2-aminobutane-1-ol, 3-aminobutane-1-ol, N-methyl-3-aminobutane-1-ol, N-ethyl-3-aminobutane-1-ol, 1-aminobutane-4-ol, N-methyl-1-aminobutane-4-ol, N-ethyl-1-aminobutane-4-ol, 1-amino-2-methylpropane-2-ol, 2-amino-2-methylpropane-1-ol, 1-aminopentane-4-ol, 2-amino-4-methylpentane-1-ol, 2-aminohexane-1-ol, 3-aminoheptane-4-ol, 1-aminooctane-2-ol, 5-aminooctane-4-ol, 1-aminopropane-2,3-diol, 2-aminopropane-1,3-diol, tris(oxymethyl)aminomethane, 1,2-diaminopropane-3-ol, 1,3-diaminopropane-2-ol, and 2-(2-aminoethoxy)ethanol.

Appropriate glycol ether solvents include, but are not limited to, ethylene glycol monomethyl ether, ethylene glycol monoethyl ether, ethylene glycol monobutyl ether, ethylene glycol dimethyl ether, ethylene glycol diethyl ether, diethylene glycol monomethyl ether, diethylene glycol monoethyl ether, diethylene glycol monopropyl ether, diethylene glycol monoisopropyl ether, diethylene glycol monobutyl ether, diethylene glycol monoisobutyl ether, diethylene glycol monobenzyl ether, diethylene glycol diethyl ether, triethylene glycol monomethyl ether, triethylene glycol dimethyl ether, polyethylene glycol monomethyl ether, diethylene glycol methyl ethyl ether, triethylene glycol, ethylene glycol monomethyl ether acetate, ethylene glycol monoethyl acetate, propylene glycol monomethyl ether, propylene glycol dimethyl ether, propylene glycol monobutyl ether, dipropyelene glycol monomethyl ether, dipropylene glycol monopropyl ether, dipropylene glycol monoisopropyl ether, dipropylene glycol monobutyl ether, dipropylene glycol dimethyl ether, dipropylene glycol dipropyl ether, dipropylene glycol diisopropyl ether, tripropylene glycol and tripropylene glycol monomethyl ether, 1-methoxy-2-butanol, 2-methoxy-1-butanol, 2-methoxy-2-methyl-2-butanol, dioxane, trioxane, 1,1-dimethoxyethane, tetrahydrofuran, crown ethers and the like.

The compositions can also optionally contain one or more corrosion inhibitors. Suitable corrosion inhibitors include, but are not limited to, aromatic hydroxyl compounds such as catechol; alkylcatechols such as methylcatechol, ethylcatechol and t-butylcatechol, phenols and pyrogallol; aromatic triazoles such as benzotriazole; alkylbenzotriazoles; carboxylic acids such as formic acid, acetic acid, propionic acid, butyric acid, isobutyric acid, oxalic acid, malonic acid, succinic acid, glutaric acid, maleic acid, fumaric acid, benzoic acid, phtahlic acid, 1,2,3-benzenetricarboxylic acid, glycolic acid, lactic acid, malic acid, citric acid, acetic anhydride, phthalic anhydride, maleic anhydride, succinic anhydride, salicylic acid, gallic acid, and gallic acid esters such as methyl gallate and propyl gallate; organic salts of carboxyl containing organic containing compounds described above, basic substances such as ethanolamine, trimethylamine, diethylamine and pyridines, such as 2-aminopyridine, and the like, and chelate compounds such as phosphoric acid-based chelate compounds including 1,2-propanediaminetetramethylene phosphonic acid and hydroxyethane phosphonic acid, carboxylic acid-based chelate compounds such as ethylenediaminetetraacetic acid and its sodium and ammonium salts, dihydroxyethylglycine and nitrilotriacetic acid, amine-based chelate compounds such as bipyridine, tetraphenylporphyrin and phenanthroline, and oxime-based chelate compounds such as dimethylglyoxime and diphenylglyoxime. A single corrosion inhibitor may be used or a combination of corrosion inhibitors may be used. Corrosion inhibitors have proven useful at levels ranging from about 1 ppm to about 10%.

Preferred optional surfactants have included fluorosurfactants. One example of a preferred fluorosurfactant is DuPont FSO (fluorinated telomere B monoether with polyethylene glycol (50%), ethylene glycol (25%), 1,4-dioxane (<0.1%), water 25%).

Preferred temperatures of at least 50° C. are preferred for contacting the substrate whereas for a majority of applications, temperatures of from about 50° C. to about 75° C. are more preferred. For particular applications where the substrate is either sensitive or longer removal times are required, lower contacting temperatures are appropriate. For example, when reworking substrates, it may be appropriate to maintain the stripper solution at a temperature of at least 20° C. for a longer time to remove the photoresist and avoid damaging to the substrate.

When immersing a substrate, agitation of the composition additionally facilitates photoresist removal. Agitation can be effected by mechanical stiffing, circulating, or by bubbling an inert gas through the composition. Upon removal of the desired amount of photoresist, the substrate is removed from contact with the stripper solution and rinsed with water or an alcohol. DI water is a preferred form of water and isopropanol is a preferred alcohol. For substrates having components subject to oxidation, rinsing is preferably done under an inert atmosphere. The preferred stripper solutions according to the present disclosure have improved loading capacities for photoresist materials compared to current commercial products and are able to process a larger number of substrates with a given volume of stripper solution.

The stripper solutions provided in this disclosure can be used to remove polymeric resist materials present in a single layer or certain types of bilayer resists. For example, bilayer resists typically have either a first inorganic layer covered by a second polymeric layer or can have two polymeric layers. Utilizing the methods taught below, a single layer of polymeric resist can be effectively removed from a standard wafer having a single polymer layer. The same methods can also be used to remove a single polymer layer from a wafer having a bilayer composed of a first inorganic layer and a second or outer polymer layer. Finally, two polymer layers can be effectively removed from a wafer having a bilayer composed of two polymeric layers.

EXAMPLES 1-13

The reactants listed in Table I were separately combined with stirring to give each of the 13 homogeneous stripper solutions. The freezing points were determined and are also provided in Table I. The compositions of Examples 1-13 can optionally be formulated without a surfactant and formulated to include a corrosion inhibitor.

TABLE I

| Example | Formulation* | Freezing Point, ° C. |
|---|---|---|
| 1 | 85.8 g DMSO (85.8%)<br>6.0 g Diethyleneglycol monomethyl ether (6.0%)<br>2.7 g Aminoethylethanolamine (2.7%)<br>5.5 g Tetramethylammonium hydroxide (5.5%) | +13.2 |
| 2 | 61 g DMSO (61%)<br>35 g Monoethanolamine (35%)<br>4 g Tetramethylammonium hydroxide (4%) | −2.5 |
| 3 | 51.5 g DMSO (51.5%)<br>35 g Diethylene glycol monomethyl ether (35%)<br>11.3 g Aminoethylethanolamine (11.3%)<br>2.2 g Tetramethylammonium hydroxide (2.2%) | −7.4 |
| 4 | 71 g DMSO (71%)<br>27.4 g Monoethanolamine (27.4%)<br>1.6 g Tetramethylammonium hydroxide (1.6%) | +5.3 |
| 5 | 27.4 g DMSO (27.4%)<br>71 g Monoethanolamine (71%)<br>1.6 g Tetramethylammonium hydroxide (1.6%) | +0.4 |
| 6 | 86 g DMSO (86.4%)<br>6 g Diethylene glycol monomethyl ether (6%)<br>2.7 g Aminoethylethanolamine (2.7%)<br>2 g Benzyltrimethylammonium hydroxide (2%)<br>3 g water (3%) | +7.7 |
| 7 | 86 g DMSO (82.1%)<br>6 g Diethylene glycol monomethyl ether (5.7%)<br>2.7 g Aminoethylethanolamine (2.6%)<br>2 g Diethyldimethylammonium hydroxide (1.9%)<br>8 g water (7.7%) | −4.6 |
| 8 | 86 g DMSO (82.1%)<br>6 g Diethylene glycol monomethyl ether (5.7%)<br>2.7 Aminoethylethanolamine (2.6%)<br>2 g Methyltriethylammonium hydroxide (1.9%)<br>8 g water (7.7%) | −5.5 |
| 9 | 86 g DMSO (87.5%)<br>6 g Diethylene glycol monomethyl ether (6.1%)<br>2.7 g Aminoethylethanolamine (2.8%)<br>2 g Tetrabutylammonium hydroxide (2%)<br>1.6 g water (1.6%) | +8.4 |
| 10 | 63 g DMSO (61.2%)<br>35 g Monoethanolamine (34%)<br>2 g Benzyltrimethylammonium hydroxide (1.9%)<br>3 g water (2.9%) | −6.3 |
| 11 | 63 g DMSO (58.3%)<br>35 g Monoethanolamine (32.4%)<br>2 g Diethyldimethylammonium hydroxide (1.9%)<br>8 g water (7.4%) | <−20 |
| 12 | 63 g DMSO (58.3%)<br>35 g Monoethanolamine (32.4%)<br>2 g Methyltriethylammonium hydroxide (1.9%)<br>8 g water (7.4%) | <−20 |
| 13 | 63 g DMSO (62.0%)<br>35 g Monoethanolamine (34.4%)<br>2 g Tetrabutylammonium hydroxide (2%)<br>1.6 g water (1.6%) | −6.2 |

*Each formulation additionally contained and optional 0.03 g of DuPont FSO (fluorinated telomere B monoether with polyethylene glycol (50%), ethylene glycol (25%), 1,4-dioxane (<0.1%), water 25%)

EXAMPLE 14

A silicon wafer having a photoresist thereon is immersed in the stripping solution from Example 1, maintained at a temperature of about 70° C. with stirring for from about 30 to about 60 minutes. The wafer is removed, rinsed with DI water and dried. Examination of the wafer will demonstrate removal of substantially all of the photoresist. For some applications, superior results may be obtained by immersing the wafer in the stripping solution without stirring. The preferred manner of removing the photoresist from a wafer can readily be determined without undue experimentation. This method can be used to remove a single layer of polymeric photoresist or two polymeric layers present in bilayer resists having two polymer layers.

EXAMPLE 15

A silicon wafer having a photoresist thereon is mounted in a standard spray device and sprayed with the stripper solution from Example 2, maintained at about 50° C. The spraying can optionally be carried out under an inert atmosphere or optionally in the presence of an active gas such as, for example, oxygen, fluorine or silane. The wafer can be removed periodically and inspected to determine when sufficient photoresist has been removed. When sufficient photoresist has been removed, the wafer can be rinsed with isopropanol and dried. This method can be used to remove a single layer of polymeric photoresist or two polymeric layers present in bilayer resists having two polymer layers.

The methods described in Examples 14 and 15 can be used with the stripper solutions of this disclosure to remove photoresists from wafers constructed of a variety of materials, including GaAs. Additionally, both positive and negative resists can be removed by both of these methods.

EXAMPLE 16

The method described in Example 14 was used to remove photoresist from the wafers described below in Table II. Twenty liter volumes of three stripper solutions were used until either a residue of photoresist polymer remained on the wafer or until re-deposition of the polymer or its degradation products onto the wafer occurred, at which point the solutions loading capacity was reached. With this method the loading capacity was determined for the two stripper solutions described in Examples 1 and 2 above and for a comparative example that is generally typical of current commercial stripper solutions.

TABLE II

| Stripping Formulation | Composition | Wafers Stripped with 20 L of Stripper Solution | Resist Loading Capacity $cm^3/L$ |
|---|---|---|---|
| From Example 1 | 85.5 g DMSO<br>6 g Diethylene glycol monomethyl ether<br>2.7 g Aminoethylethanolamine<br>5.5 g Tetramethylammonium hydroxide<br>0.03 g DuPont FSO surfactant | 150 × 200 mm wafers with 80 μm photoresist | 18.8 |

TABLE II-continued

| Stripping Formulation | Composition | Wafers Stripped with 20 L of Stripper Solution | Resist Loading Capacity $cm^3/L$ |
|---|---|---|---|
| From Example 2 | 61 g DMSO<br>35 g Monoethanolamine<br>4 g Tetramethylammonium hydroxide<br>0.03 g DuPont FSO surfactant | 200 × 300 mm wafers with 120 μm photoresist | 84.8 |
| Comparative Example | 74 g n-methylpyrrolidone<br>24 g 1,2-propanediol<br>2 g Tetramethylammonium hydroxide | 25 × 300 mm wafers with 120 μm photoresist | 10.6 |

While applicant's disclosure has been provided with reference to specific embodiments above, it will be understood that modifications and alterations in the embodiments disclosed may be made by those practiced in the art without departing from the spirit and scope of the invention. All such modifications and alterations are intended to be covered.

The invention claimed is:

1. A method for removing a photoresist from a substrate, the method comprising:

selecting a substrate having a photoresist thereon;

contacting the substrate with a stripper solution for a time sufficient to remove a desired amount of photoresist, wherein the stripper solution consisting essentially of:

from about 55 wt. % to about 90 wt. % dimethyl sulfoxide;

from about 1 wt. % to about 7 wt. % of a quaternary ammonium hydroxide;

from about 1 wt. % to about 75 wt. % of an alkanolamine having at least two carbon atoms, at least one amino substituent and at least one hydroxyl substituent, with the amino and hydroxyl substituents being attached to different carbon atoms; and from about 0.01 wt. % to about 3 wt. % of a surfactant;

optionally a corrosion inhibitor, water; or a combination thereof; and from about 2 wt. % to about 35 wt. % of a secondary solvent including a glycol ether compound;

rinsing the stripper solution from the substrate.

2. The method of claim 1 wherein the quaternary ammonium hydroxide has substituents that are $(C_1\text{-}C_8)$alkyl, arylalkyl or combinations thereof.

3. The method of claim 1 wherein the quaternary ammonium hydroxide is tetramethylammonium hydroxide.

4. The method of claim 1 wherein the alkanolamine is a compound of the formula:

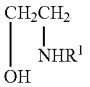

where $R^1$ is H, $(C_1\text{-}C_4)$ alkyl, or $(C_1\text{-}C_4)$ alkylamino.

5. The method of claim 4 wherein $R^1$ is hydrogen.

6. The method of claim 4 wherein $R^1$ is $CH_2CH_2NH_2$.

7. The method of claim 1 wherein the glycol ether compound is diethyleneglycol monomethyl ether.

8. The method of claim 1 wherein said contacting comprises immersing the substrate in the stripper solution.

9. The method of claim 1 wherein the stripper solution is maintained at a temperature of at least about 20° C. during the contacting.

10. The method of claim 9 wherein the stripper solution is maintained at a temperature of at least about 50° C. during the contacting.

11. The method of claim 1 wherein the rinsing is with water.

12. The method of claim 1 wherein the rinsing is with an alcohol.

13. The method of claim 8 wherein said contacting further comprises agitating the stripper solution during the immersing.

14. The method of claim 13 wherein the agitating is accomplished by mechanically stirring the stripper solution, by circulating the stripper solution, or by bubbling an inert gas through the stripper solution.

15. The method of claim 1, wherein loading capacity of said stripper composition ranges from 15 cm3/liter up to 90 cm3/liter.

16. A method comprising:

selecting a substrate having a photoresist thereon;

contacting the substrate with a stripper solution for a time sufficient to remove a desired amount of photoresist, wherein the stripper solution includes:

from about 20 wt. % to about 90 wt. % dimethyl sulfoxide;

from about 1 wt. % to about 7 wt. % of a quaternary ammonium hydroxide selected from the group consisting of tetramethylammonium hydroxide, benzyltrimethylammonium hydroxide; diethyldimethylammonium hydroxide, methyltriethylammonium hydroxide, or tetrabutylammonium hydroxide; and from about 1 wt. % to about 75 wt. % of an amine selected from the group consisting of monoethanolamine or aminoethylethanolamine;

rinsing the stripper solution from the substrate.

17. The method of claim 16, wherein the amine is aminoethylethanolamine and the quaternary ammonium hydroxide is tetramethylammonium hydroxide.

18. The method of claim 16, wherein the amine is monoethanolamine and the quaternary ammonium hydroxide is tetramethylammonium hydroxide.

19. The method of claim 16, wherein the solution includes no greater than about 3 wt. % water.

20. The method of claim 16, wherein the solution includes from about 2 wt. % to about 35 wt. % diethylene glycol monomethyl ether.

* * * * *